US005334419A

United States Patent [19]

Minami et al.

[11] Patent Number: 5,334,419

[45] Date of Patent: Aug. 2, 1994

[54] METHOD OF SIZING CARBON FIBERS

[75] Inventors: Hiroshi Minami; Yoshihiko Nakaoka; Tsuneyoshi Yamamoto, all of Aichi, Japan

[73] Assignee: Takemoto Yushi Kabushiki Kaisha, Aichi, Japan

[21] Appl. No.: 37,919

[22] Filed: Mar. 26, 1993

[30] Foreign Application Priority Data

Mar. 27, 1992 [JP] Japan ..... 4-102217
Feb. 16, 1993 [JP] Japan ..... 5-51445

[51] Int. Cl.[5] ..... B05D 3/02

[52] U.S. Cl. ..... 427/386; 423/447.1; 423/447.2; 428/367; 428/408; 428/413

[58] Field of Search ..... 427/221, 386; 428/375, 428/396, 367, 408, 413; 423/447.1, 447.2

[56] References Cited

U.S. PATENT DOCUMENTS 4,904,818 2/1990 Minami et al. ..... 528/176 X
5,167,945 12/1992 Ogawa et al. ..... 423/448

*Primary Examiner*—Michael Lusignan
*Attorney, Agent, or Firm*—Heller, Ehrman, White, & McAuliffe

[57] ABSTRACT

A method of sizing carbon fibers includes processing the carbon fibers with a water-based emulsion of sizing agents containing specified kinds of ester compound and non-ionic surfactant respectively at a specified ratio and applying a specified amount of the sizing agents to the carbon fibers.

12 Claims, No Drawings

METHOD OF SIZING CARBON FIBERS

BACKGROUND OF THE INVENTION

This invention relates to a method of sizing carbon fibers. In recent years, composite materials using carbon fibers are widely utilized in the fields of sports, leisure and aerospace technologies. Such carbon fibers are normally manufactured as filaments or tows and processed into unidirectional sheets, tapes, filament winding, cloths or chopped fibers. In the processing of carbon fibers for unidirectional prepreg widely used in sports, leisure and aerospace technologies, cohesiveness and lubricity are required qualities in order to prevent the occurrence of fluffs and yarn breakage caused by their contact friction with various guide means during yarn-handling processes. In order to obtain unidirectional prepreg sheets of high quality, on the other hand, carbon fiber yarns are required to be able to easily spread thinly and without any gaps. It is an object of the present invention to provide a method of sizing carbon fibers which can satisfy such requirements.

As an example of prior art method of sizing carbon fibers, Japanese Patent Publications Tokko 62-56266 and Tokkai 58-41973 disclosed a method of processing carbon fibers with a water-based emulsion of a sizing composition having epoxy resin derived from bisphenol as main component. Such prior art methods have problems, however, although they are capable of improving cohesiveness of carbon fibers. Firstly, since epoxy resins derived from bisphenol are poor in lubricity, fluffs and yarn breakage occur due to contact friction with various guide means during yarn-handling processes for obtaining a unidirectional prepreg sheet by using carbon fibers sized with such resins. Secondly, since epoxy resins derived from bisphenol have high stickiness, carbon fibers sized therewith have imperfect opening. At a low contact pressure, they cannot be spread into a sufficiently thin sheet and, if they are spread, many gaps are generated as a result. Thirdly, since epoxy resins derived from bisphenol and having a high molecular weight are hydrophobic and highly viscous, sizing compositions having such an epoxy resin as main component cannot easily be made into a stable water-based emulsion with small particle size or be attached to carbon fibers.

Japanese Patent Publication Tokko 62-56267 disclosed another method of sizing carbon fibers according to which carbon fibers are processed by a water-based emulsion of a sizing composition using aliphatic esters as a lubricant in addition to epoxy resins derived from bisphenol. Although lubricity is somewhat improved by this method by the use of aliphatic esters, there still remains the problem of imperfect opening of carbon fibers.

The problem addressed by the present invention, therefore, was that prior art methods could not simultaneously provide sufficient cohesiveness, lubricity and fiber-opening property to carbon fibers and that thin unidirectional prepreg sheets of high quality without any gaps could not be obtained.

SUMMARY OF THE INVENTION

The present invention was completed as a result of studies by the present inventors in view of the aforesaid problems and is based on their discovery that desired results can be obtained if carbon fibers are processed by a water-based emulsion of sizing agents with average diameter with in a specified range and comprised of a specified ester compound and a specified non-ionic surfactant respectively at a specified rate and a specified amount of these sizing agents is applied to the carbon fibers.

DETAILED DESCRIPTION OF THE INVENTION

This invention relates to a method of sizing carbon fibers, characterized by the steps of processing the carbon fibers with a water-based emulsion of sizing agents composed of one or more ester compounds selected from Group A described below and one or more non-ionic surfactant selected from Group B described below at weight ratio of (ester compound) / (surfactant)=90/10-30/70, the sizing agents having average diameter of 0.01–0.5 μm in the emulsion, and applying the sizing agents to the carbon fibers at the rate of 0.1–5.0 weight % with respect to the carbon fibers, where Group A consists of ester compounds shown by Formula (1) and ester compounds shown by Formula ( 2 ) below:

$$R^1COOR^2 \qquad \text{Formula (1)}$$

$$R^3COO(CH_2-\underset{\underset{R^5}{|}}{CH}O)_n-R^4 \qquad \text{Formula (2)}$$

and Group B consists of polyalkoxylated aliphatic carboxylic acid esters of polyhydric alcohol, aliphatic carboxylic acid esters of polyoxyalkyleneglycol and polyoxyalkyleneglycol ethers of aliphatic alcohol, where $R^1$ and $R^3$ are each saturated aliphatic hydrocarbon group with 1–29 carbon atoms, unsaturated aliphatic hydrocarbon group with 15–21 carbon atoms or hydroxy substituted aliphatic hydrocarbon group with 15–21 carbon atoms; $R^2$ is saturated aliphatic hydrocarbon group with 1–22 carbon atoms or unsaturated aliphatic hydrocarbon group with 14–22 carbon atoms; $R^4$ is saturated aliphatic hydrocarbon group with 1–22 carbon atoms, unsaturated aliphatic hydrocarbon group with 14–22 carbon atoms or alkylphenyl group having alkyl group with 4–12 carbon atoms; $R^5$ is hydrogen atom, methyl group, ethyl group, phenyl group or phenoxymethyl group such that the total carbon atom number of $R^1$ and $R^2$ is 10 or greater and the total carbon atom number of $R^2$ and $R^4$ is 10 or greater; and n is an integer 1–20.

Examples of ester compound in Group A shown by Formula (1) include (i) esters of saturated aliphatic carboxylic acid with 2–20 carbon atoms and saturated aliphatic alcohol with 1–22 carbon atoms; (ii) esters of saturated aliphatic carboxylic acid of (i) and unsaturated aliphatic alcohol with 14–22 carbon atoms; (iii) esters of unsaturated aliphatic carboxylic acid with 16–22 carbon atoms and saturated aliphatic alcohol with 1–22 carbon atoms; (iv) esters of unsaturated aliphatic carboxylic acid of (iii) and unsaturated aliphatic alcohol with 14–22 carbon atoms; (v) esters of aliphatic carboxylic acid with hydroxy substituted group with 16–22 carbon atoms and saturated aliphatic alcohol with 1–22 carbon atoms; and (vi) esters of aliphatic carboxylic acid with hydroxy substituted group of (v) and unsaturated aliphatic alcohol with 14–22 carbon atoms.

Examples of aliphatic acid which can be used for obtaining ester compounds shown by Formula (1) include (i) saturated aliphatic acids such as acetic acid, butyric acid, caproic acid, caprylic acid, capric acid, undecanoic acid, lauric acid, tridecanoic acid, myristic acid, pentadecanoic acid, palmitic acid, stearic acid, nonadecanoic acid, arachidic acid, behenic acid, cerotic acid, montanic acid and melissic acid; (ii) aliphatic monoenic carboxylic acids such as palmitoleic acid, oleic acid, elaidic acid, eicosenic acid and vaccenic acid; (iii) aliphatic nonconjugated polyenic carboxylic acids such as linoleic acid, linolenic acid and arachidonic acid; and (iv) unsaturated monohydroxyli acids such as ricinoleic acid and α-oxy-linolenic acid.

Examples of aliphatic alcohol which can be used for obtaining ester compound shown by Formula (1) include (i) saturated aliphatic primary alcohols such as methanol, ethanol, propanol, n-butanol, iso-butanol, 1-hexanol, 1-octanol, nonyl alcohol, 1-decanol, lauryl alcohol, 1-tridecanol, myristic alcohol, 1-pentadecanol, cetyl alcohol, stearyl alcohol, arachinyl alcohol and 1-docosanol; (ii) saturated aliphatic secondary alcohols such as iso-propanol, sec-butanol, 2-hexanol, 2-octanol, 2-decanol, 2-dodecanol, 2-tetradecanol, 2-hexadecanol, 2-octadecanol, 2-nonadecanol and 2-eicosanol; and (iii) unsaturated aliphatic alcohols such as 2-tetradecene-1-ol, 2-pentadecene-l-ol, 2-octadecene-l-ol, 15-hexadecene-1-ol, oleyl alcohol, linoleyl alcohol, ricinoleyl alcohol and eleostearyl alcohol.

Many kinds of ester compound shown by Formula (1) can be obtained, depending on the combination of aliphatic acid and aliphatic alcohol which are used, but the total number of carbon atoms contained in the hydrocarbon groups of the aliphatic acid part and the aliphatic alcohol part must be 10 or greater, and more preferably 15–40.

Preferable among the ester compounds shown by Formula (1) are those obtained by using aliphatic acids and aliphatic alcohols, at least one of which has alkenyl group with 16–20 carbon atoms. Examples of such ester compound include (i) esters of palmitoleic acid such as octyl palmitoleate, lauryl palmitoleate and oleyl palmitoleate; (ii) esters of oleic acid such as lauryl oleate, stearyl oleate, oleyl oleate, octyl oleate, tridecyl oleate, methyl oleate, butyl oleate and 2-ethylhexyl oleate; (iii) esters of eicosenic acid such as oleyl eicosenate and lauryl eicosenate; (iv) esters of hexadecenol such as hexadecenyl laurate, hexadecenyl palmitate, hexadecenyl oleate and hexadecenyl stearate; and (v) esters of oleyl alcohol such as oleyl stearate, oleyl palmitate, oleyl laurate, oleyl isostearate and oleyl octanoate. Particularly preferable among them are those obtained from aliphatic acid and aliphatic alcohol, both of which contain alkenyl group with 16–20 carbon atoms.

Ester compounds in Group A shown by Formula (2) are those obtained by using aforementioned aliphatic acid which is used for obtaining ester compounds shown by Formula (1) and (poly)glycol ether obtained by ring-opening addition of 1,2-epoxide to saturated aliphatic alcohol with 1–22 carbon atoms, unsaturated aliphatic alcohol with 14–22 carbon atoms or alkyl phenol having alkyl group with 4–12 carbon atoms.

Examples of (poly)glycol ether which can be used for obtaining ester compounds shown by Formula (2) include (i) 1,2-epoxy adducts of aforementioned aliphatic alcohols from which ester compounds of Formula (1) can be obtained; and (ii) 1,2-epoxy adducts of alkylphenol such as butyl phenol, octyl phenol, nonyl phenol and dodecyl phenol.

Examples of 1,2-epoxide which can be used for obtaining aforementioned (poly)glycol ethers include ethylene oxide, propylene oxide, 1,2-butylene oxide, styrene oxide and phenyl glycidyl. Such 1,2-epoxide is added by 1–20 moles per mole of hydroxyl group of aforementioned aliphatic alcohol or alkyl phenol. (Poly)glycol ethers include those with single 1,2-epoxide added thereto and those with two or more different kinds of 1,2-epoxide added randomly or in blocks. Preferable among them are single or mixed adducts of ethylene oxide and propylene oxide. Even more preferable are 1–5 mole adducts.

Many kinds of ester compound shown by Formula (2) can be obtained, depending on the combination of aliphatic acid and (poly)glycol ether which are used, but the total number of carbon atoms contained in the hydrocarbon groups of the aliphatic acid part and the aliphatic alcohol or alkyl phenol part from which (poly)glycol ether is obtained must be 10 or greater, and more preferably 15–40.

Preferable among the ester compounds shown by Formula (2) are those obtained by using aliphatic acids and (poly)glycol ethers, at least one of which has alkenyl group with 16–20 carbon atoms. Examples of such ester compound include (i) (poly)glycol ether palmitoleates such as polyoxyethylene (5 mole) laurylether palmitoleate, polyoxypropylene (3 mole) stearylether palmitoleate and polyoxyethylene (3 mole) oleylether palmitoleate; (ii) (poly)glycol ether oleates such as polyoxyethylene (3 mole) laurylether oleate, polyoxypropylene (5 mole) isotridecylether oleate and oleoxyethyl oleate; (iii) (poly)glycol ether eicosenates such as polyoxyethylene (3 mole) laurylether eicosenate and polyoxypropylene (3 mole) oleylether eicosenate; and (iv) esters of oleyl (poly)glycol ether such as polyoxyethylene (3 mole) oleylether laurate, polyoxypropylene (3 mole) oleylether stearate, polyoxyethylene (3 mole)/polyoxypropylene (2 mole) oleylether palmitate and oleoxyethyl eicosanoate. Particularly preferable among them are those obtained from aliphatic acid and (poly)glycol ether, both of which contain alkenyl group with 16–20 carbon atoms.

Examples of non-ionic surfactant in Group B include polyalkoxylated aliphatic carboxylic acid esters of polyhydric alcohol, aliphatic carboxylic acid esters of polyoxyalkyleneglycol and polyoxyalkyleneglycol ethers of aliphatic alcohol. In these examples, the oxyalkylene groups must have 2–4 carbons atoms.

Examples of aforementioned polyalkoxylated aliphatic carboxylic acid ester of polyhydric alcohol include (i) alkylene oxide adducts of partial ester of trihydric-hexahydric alcohol and aliphatic acid; (ii) partial or complete esters of alkylene oxide adduct of trihydric-hexahydric alcohol and aliphatic acid; and (iii) alkylene oxide adduct of ester of trihydric-hexahydric alcohol and hydroxy aliphatic acid. Examples of trihydric-hexahydric acid to be used above include glycerine, diglycerine, trimethylol propane, trimethylol ethane, pentaerithrytol, sorbitol and sorbitan.

Examples of aforementioned aliphatic carboxylic acid ester of polyoxyalkyleneglycol include aliphatic carboxylic acid monoesters of polyoxyalkyleneglycol and aliphatic carboxylic acid diesters of polyoxyalkyleneglycol.

Regarding non-ionic surfactant of Group B, the kind of material for hydrophobic group, the kind of alkylene oxide and its amount (the number of moles) to be added can be freely selected, depending upon the kind of ester compound in Group A to be used together and at what ratio it is used. Normally, however, it is preferable to use aliphatic acid or aliphatic alcohol with 8–22 carbon atoms as starting material and ethylene oxide singly or a mixture of ethylene oxide and propylene oxide as alkylene oxide. Such non-ionic surfactant may be used singly or in combinations, but it is preferable to use two or more kinds in a combination- Examples of preferred combination include the combination of polyalkoxylated glycerine triricinolate, polyoxyalkylene sorbitan oleate, polyalkoxylated sorbitol oleate and polyglycol ether obtained by ring-opening addition of 1,2-epoxide to aliphatic alcohol with 16–20 carbon atoms.

Sizing agents according to the present invention comprise at least one kind of ester compound of Group A and at least one kind of non-ionic surfactant of Group B as explained above each at a specified rate. The weight ratio between the ester compound of Group A and the non-ionic surfactant of Group B should be 90/10–30/70, and more preferably 70/30–50/50. If the weight ratio is greater than 90/10, the sizing agent which is obtained cannot be made into a good water-based emulsion. If the weight ratio is smaller than 30/70, on the other hand, the sizing agent which is obtained cannot provide sufficient cohesiveness to carbon fibers, increasing fluffs during a yarn-handling process and adversely affecting the fiber-opening property when unidirectional prepreg is being produced.

Sizing agents according to the present invention can be made into a water-based emulsion by appropriate methods so as to have an average particle diameter of 0.01–0.5 μm in the emulsion. Normally, such water-based emulsion is prepared as an emulsion or an aqueous solution containing 1–50 weight % of sizing agents. For processing carbon fibers, it is prepared to 0.1–10 weight %. Dipping and spray methods can be used for the processing of carbon fibers with such a water-based emulsion.

According to the present invention, carbon fibers are processed with a water-based emulsion such that sizing agents are deposited at the rate of 0.1–5.0 weight % or preferably 0.3–2.0 weight % with respect to the carbon fibers. This is for the purpose of providing superior cohesiveness, lubricity and fiber-opening property to the carbon fibers simultaneously. If this rate is less than 0.1 weight %, fluffs and yarn breakage are likely to occur during yarn-handling processes. If the rate exceeds 5 weight %, on the other hand, the carbon fibers become sticky and the fiber-opening property becomes adversely affected during the process of obtaining unidirectional prepreg sheet and/or the penetration of resins becomes poor when a composite material is formed, thereby adversely affecting the physical characteristics of the composite material.

The present invention is extremely effective if applied to carbon fiber bundles or more than 500 filaments obtained by heating a precursor of acrylic filaments or from pitch. Sizing agents, which are used according to the present invention, cover the surfaces of these carbon fibers uniformly, providing them with sufficient cohesiveness and lubricity. Carbon fibers, which have been processed by a method according to the present invention, hardly have any fluffs or yarn breakages during yarn-handling processes and can be easily spread into a thin sheet without gaps. In summary, unidirectional prepreg sheets of a high quality can be produced with high productivity according to the present invention. Moreover, since there is good affinity between the sizing agents and epoxy resins which serve as matrix, adhesiveness of the composite material using the unidirectional prepreg is not adversely affected and composite materials with desired physical characteristics can be obtained.

In what follows, effects of the present invention will be illustrated by way of experimental results.

Test Series 1 (Synthesis of Ester Compounds)

Synthesis of Ester Compound P-5

Oleic acid 565 g (2.0 moles) and lauryl alcohol 749 g (2.01 moles) were taken inside a flask. After they were melted at 100° C. in the atmosphere of nitrogen, paratoluene sulfonic acid 5.0 g was added to be reacted for 4 hours at 120° C. under a reduced pressure condition of 2mmHg. Next, the pressure was returned to a normal level at 105° C. in the atmosphere of nitrogen and a catalyst was disposed of by adding an adsorptive agent. It was then filtered at 90° C. to obtain lightly yellow Ester Compound P-5, of which acid value was 0.8 and saponification value was 124.

Synthesis of Ester Compound Q-2

Palmitolic acid 509g (2.0 moles) and polyoxyethylene (5 mole) glycol oleylether 982g (2.01 moles) were taken inside a flask. After they were melted at 100° C. in the atmosphere of nitrogen, paratoluene sulfonic acid 5.0 g was added to be reacted for 3 hours at 120° C. under a reduced pressure condition of 1.5 mmHg. Next, the pressure was returned to a normal level at 105° C. in the atmosphere of nitrogen and a catalyst was disposed of by adding an adsorptive agent. It was then filtered at 80° C. to obtain lightly yellow Ester Compound Q-2, of which acid value was 0.4 and saponification value was 77.

Synthesis of Ester Compounds P-1, 2, 3, 4, 6 and Q-1, 3, 4

Ester Compounds P-1, 2, 3, 4, and 6 were obtained similarly to Ester Compound P-5, and Ester Compounds Q-1, 3 and 4 were obtained similarly to Ester Compound Q-2. The kinds of materials used for their syntheses and their characteristics are shown together in Table 1.

TABLE 1

| | P-1 | P-2 | P-3 | P-4 | P-5 | P-6 | Q-1 | Q-2 | Q-3 | Q-4 |
|---|---|---|---|---|---|---|---|---|---|---|
| (Materials used) | A-1 | A-2 | A-1 | A-4 | A-1 | A-1 | A-5 | A-2 | A-3 | A-4 |
| Aliphatic acid | | | | | | | | | | |
| Alcohol | B-6 | B-6 | B-2 | B-6 | B-1 | B-5 | B-7 | B-7 | B-3 | B-4 |
| Acid value | 0.3 | 0.3 | 0.4 | 0.3 | 0.8 | 0.3 | 0.4 | 0.4 | 0.4 | 0.4 |

TABLE 1-continued

| | P-1 | P-2 | P-3 | P-4 | P-5 | P-6 | Q-1 | Q-2 | Q-3 | Q-4 |
|---|---|---|---|---|---|---|---|---|---|---|
| Saponification value | 105 | 111 | 111 | 100 | 124 | 165 | 73 | 77 | 73 | 61 |

where:
A-1: Oleic acid;
A-2: Palmitolic acid;
A-3: Myristic acid;
A-4: Eicosenic acid;
A-5: Ricinoleic acid;
B-1: Lauryl alcohol;
B-2: Hexadecenyl alcohol;
B-3: Polyoxypropylene (5 mole) oleyl ether;
B-4: Polyoxyethylene/Polyoxypropylene (5 mole/3 mole) nonylphenylether;
B-5: n-butyl alcohol;
B-6: Oleyl alcohol;
B-7: Polyoxyethylene (5 mole) glycol oleylether;
Acid values in KOHmg/g;
Saponification values in KOHmg/g.

Test Series 2 (Preparation of Water-Based Emulsions)

Preparation of Water-Based Emulsion I-1

After 120 g of Ester Compound P-1 synthesized in Test Series 1 was mixed with non-ionic surfactant consisting of 60 g of polyoxyethylene (12 mole) adduct of hydrogenated castor oil and 20 g of polyoxyethylene (16 mole)/polyoxypropylene (4 mole) laurylether and melted at 90° C., the mixture was cooled down to 40 ° C. and 800 g of water at 40° C. was gradually added to it with stirring to obtain 20% (hereinafter in weight %) Water-Based Emulsion I-1 of sizing agents.

Preparation of Water-Based Emulsions I-2–I12 and R-5–R-7

Similarly as described above for the preparation of Water-Based Emulsion I-1, 20% water-based emulsions of sizing agents I-2–I-12 and R-5–R-7 were obtained.

Preparation of Water-Based Emulsion R-1

After 50 g of solid epoxy resin (EPON-1001 of Shell Oil, Inc.) and 100 g of liquid epoxy resin (EPON-828 of Shell Oil, Inc.) were added and heated together at 90° C., 50 g of polyoxyethylene (85 mole) nonylphenylether was added as surfactant. This was dispersed in 800 g of water to obtain Water-Based Emulsion R-1 of sizing agents.

Preparation of Water-Based Emulsion R-2

After 30 g of liquid epoxy resin (EPON-828 of Shell Oil, Inc.), 20 g of polyester obtained from 2.0 moles of ethylene oxide 2.0 mole adduct of bisphenol A, 1.5 moles of maleic acid and 0.5 moles of sebacic acid and 5 g of polyoxyethylene (70 mole) styrenated (5 mole) cumylphenol were heated at 60° C., 220 g of water was gradually added to it for phase change emulsification at 30° C. to obtain 20% Water-Based Emulsion R-2 of sizing agents.

Preparation of Water-Based Emulsion-3

After 70 g of epoxy resin (EPON-828 of Shell Oil, Inc.) was mixed with 4 g of polyoxyethylene (5 mole) octylphenylether, 18 g of polyoxyalkylene {PO/EO molar ratio ⅓, 3 moles} polyoxyethylene (25 mole) pentabenzyl phenylphenylether and 8 g of oleyl oleate, they were heated at 80° C. and melted. Warm water 20 g of 50°–60° C. was gradually added to it with stirring and after a phase change, 380 g of same warm water was added to produce an emulsion. It was cooled immediately thereafter to 20° C. to obtain 20% Water-Based Emulsion R-3 of sizing agents.

Preparation Of Water-Based Emulsion R-4

After 50 g of epoxy resin (EPON-828 of Shell Oil, Inc.) was mixed with 10 g of polyoxyethylene (10 mole) polyoxypropylene (2 mole) random adduct of castor oil, 10 g of polyoxyethylene (16 mole) polyoxypropylene (4 mole) block adduct of laurylether and 30 g of polyoxyethylene (5 mole) oleylether ricinoleate were mixed, they were heated at 80° C. and melted. Warm water 20g of 50°–60° C. was gradually added to it with stirring and after a phase change, 380 g of same warm water was added to produce an emulsion. It was cooled immediately thereafter to 20° C. to obtain 20% Water-Based Emulsion R-4 of sizing agents.

Contents of Water-Based Emulsions I-1–I-12 and R-1–R-7 are shown together in Table 2.

TABLE 2

| | Composition | |
|---|---|---|
| | Ester Compound (%) | Non-Ionic Surfactant (%) |
| I-1 | P-1(60) | K-2(10), K-7(30) |
| I-2 | P-1(40) | K-3(40), K-6(20) |
| I-3 | P-2(70) | K-8(20), K-6(10) |
| I-4 | P-3(65) | K-5(25), K-2(10) |
| I-5 | P-4(65) | K-9(20), K-2(15) |
| I-6 | P-5(60) | K-4(10), K-7(30) |
| I-7 | P-6(60) | K-4(10), K-7(30) |
| I-8 | Q-1(60) | K-3(30), K-5(10) |
| I-9 | Q-1(70) | K-1(20), K-4(10) |
| I-10 | Q-2(60) | K-1(20), K-4(20) |
| I-11 | Q-3(60) | K-3(10), K-5(30) |
| I-12 | Q-4(60) | K-3(20), K-6(20) |
| R-1 | Epoxy resin(75), K-10(25) | |
| R-2 | Epoxy resin(54.5), polyester (36.4), K-11(9.1) | |
| R-3 | Epoxy resin(70), P-1(8), K-12(4), K-13(18) | |
| R-4 | Epoxy resin(50), Q-1(30), K-1(10), K-4(10) | |
| R-5 | P-2(95) | K-4(3), K-7(2) |
| R-6 | P-6(20) | K-4(20), K-7(60) |
| R-7 | P-8(95) | K-1(5) |

where:
P-1–P-6 and Q-1–Q-4: Those synthesized in Test Series 1;
K-1: POE (10 mole)/POP (2 mole)-R-castor oil;
K-2: POE (10 mole) oleylether;
K-3: POE (7 mole)/POP (2 mole)-R-laurate;
K-4: POE (16 mole)/POP (4 mole)-B-laurylether;
K-5: POE (10 mole) sorbitan monooleate;
K-6: POE (8 mole)/POP (2 mole)-R-isostearylether;
K-7: POE (12 mole) hydrogenated castor oil;
K-8: POE (25 mole) castor oil;
K-9: POE (20 mole) sorbitol dioleate;
K-10: POE (85 mole) nonylphenylether;
K-11: POE (70 mole) styrene (5 mole) cumylphenol;
K-12: POE (5 mole) octylphenylether;
K-13: Polyoxyalkylene {oxypropylene/oxyethylene molar ratio = ⅓, 3 moles} POE (25 mole) pentabenzyl phenylphenylether;
POE: Polyoxyethylene;
POP: Polyoxypropylene;
POB: Polyoxybutylene;
R: Random addition;
B: Block addition.

Test Series 3 (Evaluation Of Water-Based Emulsion)

Stability of each water-based emulsion of sizing agents obtained in Test Series 2 was evaluated as follows, and the results are shown in Table 3.

Stability of Water-Based Emulsions

Stability of each water-based emulsion of sizing agents was evaluated as follows both right after its preparation and after it was left for 10 days at 25° C.:

A: Semisolubilization state and no separation;
B: Cloudy and no separation;
C: Slight precipitation or creamy separation;
D: Creamy separation or precipitation.

Measurement of Average Particle Diameter of Emulsified Sizing Agents

The average particle diameter of emulsified sizing agents was measured by using an electrophoretic light scattering spectrophotometer manufactured by Otsuka Electronic Co., Ltd.

Test Series 4 (Test Examples and Comparison Examples)

Attachment to Carbon Fibers

Each of the water-based emulsions of sizing agents obtained in Test Series 2 was used for secondary preparation of 2% water-based emulsion. Unsized carbon fiber (tensile strength=360 kg/mm$^2$, tensile modulus=23.5t/mm$^2$, with 12000 filaments) obtained from polyacrylonitrile fibers was continuously dipped in each of such emulsions and continuously dried by passing it through an oven at 120° C. by controlling the squeezing of it such that the rate of attachment of the sizing agents on the carbon fiber would be 1.5%.

Evaluation of Cohesiveness

Friction test between fibers was carried out by using a rubbing tester (of Toyo Seikisha) under the following conditions:

Load=150 g/12000 filaments;
Internal angle=35°;
Number of twists=1;
Distance of rubbing=20 mm;
Speed=100 times/minute.

Friction test between fiber and metal was carried out by using a TM type yarn friction and rubbing tester (of Daiei Kagaku Seikisha) under the following conditions:

Load=150 g/12000 filaments;
Internal angle=150° C.;
Distance of rubbing=30 mm;
Speed=150 times/minutes against chromium-coated metal.

The results of these two friction tests were evaluated by a five-point method according to the following standard and their average values were used for evaluation:

5: No fluffs, no filament breakage;
4: Some fluffs;
3: Presence of fluffs;
2: Many fluffs, presence of filament breakage;
1: Cut.

The results are also shown in Table 3.

Evaluation Of Lubricity

Coefficient of friction between fibers (F/F) was obtained by winding a carbon fiber around a cylinder with diameter 5.1 cm and length 7.6 cm, hanging a carbon fiber over it opposite to the direction of the winding, causing the cylinder to rotate with a load $T_1$ thereon, and measuring the tension $T_2$ at the same time under the condition of 20° C. and 65% RH. Coefficient of friction between fiber and metal (F/M) was obtained by measuring the tension $T_2$ similarly as above but without winding a fiber around the cylinder. The results are also shown in Table 3.

Evaluation of Fiber-Opening (F-O) Property No. 1

Evaluation of yarn spread by contact pressure with a bar

Use was made of an apparatus with three stainless bars of diameter 10 mm having a smooth surface such that carbon fibers can pass them in zigzag at contact angles of 120°. Carbon fibers were passed therethrough with the entry-side tension per denier=0.1 g and yarn speed of 5 m/minute, and the width of the fibers after passing the apparatus was measured. The results are also shown in Table 3.

Evaluation of Fiber-Opening (F-O) Property No. 2

Evaluation ok yarn spread in a unidirectional prepreg sheet

Use was made of epoxy resin coating paper (hardening at 120° C.) to produce by a dry method a unidirectional prepreg sheet with carbon fibers at the rate of 100 g/m$^2$ and resin content of 33%, and the spread of yarns was evaluated according to the following standard:

A: Uniform sheet with hardly any gaps;
B: Carbon fibers have gaps slightly;
C: Many gaps in carbon fibers.

The results of the test are also shown in Table 3.

Evaluation of Interlaminar Shear Strength (ILSS)

Prepreg sheets produced for Evaluation of Fiber-Opening Property No. 2 were piled in layers inside a mold to produce a molded product with a pressure of 7 kgG/cm$^2$ at 120° C. for 40 minutes. The interlaminar shear strength (ILSS) of the composite thus obtained was measured according to ASTMΔD-2344. The results are also shown in Table 3.

As should be clear from the disclosure above, the present invention makes is possible to provide cohesiveness, lubricity and fiber-opening property to carbon fibers at the same time and hence to produce unidirectional prepreg sheets of high quality which are thin and have no gaps. In other words, the present invention makes it possible to provide composites with desired physical characteristics by using such prepreg sheets.

TABLE 3

| | Sizing Agent | Stability *1 | Stability *2 | Cohesiveness (point) | Lubricity F/F | Lubricity F/M | F-O 1 (mm) | F-O 2 | ILSS (kg/mm$^2$) |
|---|---|---|---|---|---|---|---|---|---|
| (Test Examples) | | | | | | | | | |
| 1 | I-1 | B | B | 5 | 0.21 | 0.23 | 12 | A | 8.1 |
| 2 | I-2 | B | B | 5 | 0.21 | 0.23 | 11 | A | 7.9 |
| 3 | I-3 | A | A | 5 | 0.20 | 0.23 | 12 | A | 7.8 |
| 4 | I-4 | A | A | 5 | 0.20 | 0.22 | 13 | A | 8.1 |
| 5 | I-5 | A | A | 5 | 0.20 | 0.22 | 12 | A | 8.0 |
| 6 | I-6 | B | B | 5 | 0.21 | 0.23 | 12 | A | 8.0 |
| 7 | I-7 | A | A | 5 | 0.21 | 0.24 | 11 | A | 7.9 |
| 8 | I-8 | A | A | 5 | 0.21 | 0.23 | 12 | A | 8.0 |
| 9 | I-9 | A | A | 5 | 0.22 | 0.23 | 11 | A | 7.8 |
| 10 | I-10 | A | A | 5 | 0.22 | 0.23 | 11 | A | 7.8 |
| 11 | I-11 | A | A | 5 | 0.21 | 0.23 | 11 | A | 7.9 |
| 12 | I-12 | A | A | 5 | 0.20 | 0.22 | 12 | A | 8.1 |
| (Comparison Examples) | | | | | | | | | |

TABLE 3-continued

| | Sizing Agent | Stability *1 | Stability *2 | Cohesiveness (point) | Lubricity F/F | Lubricity F/M | F-O 1 (mm) | F-O 2 | ILSS (kg/mm²) |
|---|---|---|---|---|---|---|---|---|---|
| 1 | R-1 | B | D | 2 | 0.26 | 0.30 | 6 | C | 7.1 |
| 2 | R-2 | B | C | 4 | 0.24 | 0.26 | 7 | B | 7.5 |
| 3 | R-3 | B | B | 4 | 0.24 | 0.25 | 9 | B | 7.6 |
| 4 | R-4 | B | C | 4 | 0.25 | 0.26 | 8 | B | 7.6 |
| 5 | R-5 | C | D | | Separated: No sizing possible | | | | |
| 6 | R-6 | B | B | 2 | 0.22 | 0.24 | 8 | B | 7.0 |
| 7 | R-7 | C | D | | Separated: No sizing possible | | | | |

where:
*1: Immediately afterward;
*2: 10 days later;
Lubricity (μ): in units of 18 m/min.

What is claimed is:

1. A method of sizing carbon fibers comprising the steps of:

processing said carbon fibers with a water-based emulsion of sizing agents comprising one or more ester compounds selected from Group A described below and non-ionic surfactant at weight ratio of 90/10–30/70, said sizing agents having average diameter of 0.01–0.5 μm in said water-based emulsion; and applying said sizing agents to said carbon fibers at a rate of 0.1–5.0 weight % with respect to said carbon fibers;

said Group A consisting of ester compounds shown by Formula (1) below and ester compounds shown by Formula (2) below:

$$R^1COOR^2 \qquad \text{Formula (1)}$$

$$R^3COO(CH_2-\underset{\underset{R^5}{|}}{CHO})_n-R^4 \qquad \text{Formula (2)}$$

and said surfactant being one or more selected from Group B consisting of polyalkoxylated aliphatic carboxylic acid esters of polyhydric alcohol, aliphatic carboxylic acid esters of polyoxyalkyleneglycol and polyoxyalkyleneglycol ethers of aliphatic alcohol, where $R^1$ and $R^3$ are each saturated aliphatic hydrocarbon group with 1–29 carbon atoms, unsaturated aliphatic hydrocarbon group with 15–21 carbon atoms or hydroxy substituted aliphatic hydrocarbon group with 15–21 carbon atoms; $R^2$ is saturated aliphatic hydrocarbon group with 1–22 carbon atoms or unsaturated aliphatic hydrocarbon group with 14–22 carbon atoms; $R^4$ is saturated alphatic hydrocarbon group with 1–22 carbon atoms, unsaturated aliphatic hydrocarbon group with 14–22 carbon atoms or alkylphenyl group having alkyl group with 4–12 carbon atoms; $R^5$ is hydrogen atom, methyl group, ethyl group, phenyl group or phenoxymethyl group such that the total carbon atom number of $R^1$ and $R^2$ is 10 or greater than the total carbon atom number of $R^2$ and $R^4$ is 10 or greater; and n is an integer 1–20.

2. The method of claim 1 wherein said ester compound shown by said Formula (1) is obtained from aliphatic carboxylic acids and aliphatic alcohols, at least one of which has alkenyl group with 16–20 carbon atoms.

3. The method of claim 1 wherein said ester compound shown by said Formula (2) is obtained from aliphatic acids and (poly)glycol ethers obtained by ring-opening addition of 1,2-epoxide to aliphatic alcohol, at least of one of said aliphatic acids and said (poly)glycol ethers having alkenyl group with 16–20 carbon atoms.

4. The method of claim 1 wherein said non-ionic surfactant is obtained from at least one selected from a group consisting of polyoxyalkylene glyceryl triricinolate, polyoxyalkylene sorbitan oleate and polyoxyalkylene sorbitol oleate, and polyglycolether of aliphatic alcohol with 16–20 carbon atoms.

5. The method of claim 2 wherein said non-ionic surfactant is obtained from at least one selected from a group consisting of polyoxyalkylene glyceryl triricinoleate, polyoxyalkylene sorbitan oleate and polyoxyalkylene sorbitol oleate, and polyglycolether of aliphatic alcohol with 16–20 carbon atoms.

6. The method of claim 3 wherein said non-ionic surfactant is obtained from at least one selected from a group consisting of polyoxyalkylene glyceryl triricinolate, polyoxyalkylene sorbitan oleate and polyoxyalkylene sorbitol oleate, and polyglycolether of aliphatic alcohol with 16–20 carbon atoms.

7. The method of claim 1 wherein said sizing agents contain said ester compound and said non-ionic surfactant at weight ratio of 70/30–50/50.

8. The method of claim 2 wherein said sizing agents contain said ester compound and said non-ionic surfactant at weight ratio of 70/30–50/50.

9. The method of claim 3 wherein said sizing agents contain said ester compound and said non-ionic surfactant at weight ratio of 70/30–50/50.

10. The method of claim 4 wherein said sizing agents contain said ester compound and said non-ionic surfactant at weight ratio of 70/30–50/50.

11. The method of claim 5 wherein said sizing agents contain said ester compound and said non-ionic surfactant at weight ratio of 70/30–50/50.

12. The method of claim 6 wherein said sizing agents contain said ester compound and said non-ionic surfactant at weight ratio of 70/30–50/50.

* * * * *